US007082080B2

(12) United States Patent
Terzian

(10) Patent No.: US 7,082,080 B2
(45) **Date of Patent: *Jul. 25, 2006**

(54) ENHANCED PROMPTS FOR SETTING OR RESETTING DIGITAL TIME DISPLAYS

(75) Inventor: Berj A. Terzian, Newbury, MA (US)

(73) Assignee: Equitime, Inc., Newburry, MA (US)

( * ) Notice: Subject to any disclaimer, the term of this patent is extended or adjusted under 35 U.S.C. 154(b) by 266 days.

This patent is subject to a terminal disclaimer.

(21) Appl. No.: 10/652,599

(22) Filed: Aug. 28, 2003

(65) Prior Publication Data

US 2004/0213089 A1 Oct. 28, 2004

Related U.S. Application Data

(63) Continuation-in-part of application No. 10/424,290, filed on Apr. 25, 2003, now abandoned.

(51) Int. Cl.
*G04C 17/00* (2006.01)
*G94C 19/00* (2006.01)

(52) U.S. Cl. ..... 368/82; 368/239

(58) Field of Classification Search ..... 368/28, 368/29, 69–73, 82–84, 223, 239–242
See application file for complete search history.

(56) References Cited

U.S. PATENT DOCUMENTS

| | | | | | |
|---|---|---|---|---|---|
| 4,271,497 | A | * | 6/1981 | Terzian | 368/82 |
| 4,354,260 | A | * | 10/1982 | Planzo | 368/10 |
| 4,627,737 | A | * | 12/1986 | Nance et al. | 368/239 |
| 4,887,249 | A | * | 12/1989 | Thinesen | 368/10 |
| 5,343,446 | A | * | 8/1994 | Simmons et al. | 368/251 |
| 6,215,736 | B1 | * | 4/2001 | Terzian | 368/82 |
| 6,807,130 | B1 | | 10/2004 | Terzian | |

* cited by examiner

*Primary Examiner*—Vit W. Miska
(74) *Attorney, Agent, or Firm*—Lucas & Mercanti, LLP

(57) ABSTRACT

Balanced, quadribalanced, enhanced quadribalanced or unidirectional segmented digital time display systems are modified by inclusion of enhanced prompts which readily distinguish such real time displays and which comprise the letters AL, dA, and each of M, D and Y in pairs, to symbolize that the displays are in modes for setting or resetting an alarm time or calendar values such as the current day name and the current month, day or year dates.

35 Claims, 4 Drawing Sheets

ENHANCED PROMPTS FOR SETTING OR RESETTING DIGITAL TIME DISPLAYS

CROSS-REFERENCE TO RELATED APPLICATIONS

This application is a continuation-in-part of U.S. patent application Ser. No. 10/424,290 filed Apr. 25, 2003 now abandoned.

BACKGROUND OF THE INVENTION

1. Field of the Invention

This invention relates to timekeeping and, more particularly, to the formation of prompts to facilitate the setting or resetting of digital time displays which are suitable for general purpose timekeeping, as most individuals customarily use to coordinate their daily activities with desired or required time schedules.

2. Description of the Prior Art

Balanced, quadribalanced and enhanced quadribalanced digital time displays are disclosed in the prior art. Examples of patents which describe such displays include U.S. Pat. No. 4,627,737, U.S. Pat. No. 4,271,497 and U.S. Pat. No. 6,215,736 B1, the disclosures of which are incorporated herein by reference. These displays have a common characteristic, which is that at the conclusion of the first half of each hour, the time information transitions from elapsed time to remaining time.

More specifically, during the first half hour, the current hour in these displays is flanked on its right side by incrementing elapsed minutes in a single or dual up/down position. Thereafter, the hour value increases by one to display the oncoming next hour, minutes switch to a single or dual down/up position flanking the left side of that hour and begin counting down the remaining 30 minutes before that hour commences. Seconds can also be included to count 59 seconds up during each elapsed minute and 59 seconds down during each remaining minute.

3. Recognition of Problems in the Prior Art

In the above-described prior art displays, only the digital hour and seconds remain in stationary positions, while digital minutes move in successive right to left positions flanking the centrally displayed hours, simulating rotary-like motions from hour to hour.

Because such displays occupy relatively larger areas of the overall display field than conventional digital displays, there is a need to determine how such field should be modified when switching from a real time mode to a setting mode for setting or resetting real or alarm times and calendar values. Another consideration is whether or how to include cues or prompts in the displays in order to provide differentiation between the real time displays and the displays provided for setting or resetting either a real or an alarm time.

Such cues or prompts should have singular characteristics which not only differentiate between real time and the setting or resetting of real or alarm times, but also between the setting of either of such time values and the setting of calendar values, such as day names and the dates of a current month, day or year.

Ideally, through the aid of effective prompts, the viewer should immediately become aware of which values are available for setting or resetting with utmost clarity and comprehension, so that there is little or no uncertainty or confusion, thereby minimizing or avoiding the risk of error or failure.

SUMMARY OF THE INVENTION

Co-pending application Ser. No. 10/356,889, the disclosure of which is incorporated herein by reference, describes prompts for symbolizing displays which are suitable for setting real and alarm times and certain calendar values. The present invention provides more effective visual prompts, each having singular characteristics such that a viewer is immediately informed that a setting or resetting mode has been activated for the setting or resetting of real time and alarm time values, and calendar values, in a balanced type of digital time display. Such prompts are more representative, and therefore better recognizable and comprehensible, of the particular function that is available for setting than the ones in the '889 application. Also, the prompts of this invention fill more of the display fields and exhibit parallel prompt symmetries when setting the calendar values of months, days and years. Therefore, the prompts of the present invention facilitate the setting or resetting of digital time and calendar sequences with maximum clarity and certainty, so that the viewer is assured of being able to comprehend what is under way during any one of such setting or resetting procedures.

This is especially useful for the balanced, quadribalanced and enhanced quadribalanced displays of the prior art because those displays normally leave one-half or three quarters of the display areas reserved for digital minutes without time information during the course of each hour. This condition is substantially contrasted by the enhanced prompts of the present invention which, during the improved setting modes, not only fill substantially the entire display area, but also generate appearances which are immediately distinguishable from the usual real time appearances. Such visual differentiation between the real time displays and the setting or resetting time displays further facilitates performing the latter without confusion or error.

An important advantage of these features is that both the prompted real time and alarm time setting modes can be, and preferably are, displayed in terms of elapsed minutes and seconds past a current hour, regardless of the specific point in time at which one or the other of these modes is accessed during the course of an hour. Therefore, when the real time setting mode is activated during the second half of an hour, the resulting automatic transition from remaining minutes and seconds before a next hour to the equivalent elapsed minutes and seconds past a current hour facilitates accessing exact time announcements available from telephone, television or radio, etc., which are usually also given in elapsed time, thus simplifying synchronization and setting or resetting the display to the announced time. Accordingly, the potentially difficult mental conversion of a remaining time display to an equivalent elapsed time announcement during a second half hour setting or resetting procedure is avoided and eliminated by the present invention.

Similar advantages are achieved by the prompted alarm time setting mode provided by the invention. By forming this mode in a similar elapsed time format and content as the real time setting mode, setting or resetting the minutes and hour of a desired alarm time during the second half hour, by mental conversion of such desired alarm time to equivalent remaining time, is also avoided. In addition, the similarity of the alarm setting mode to the real time setting mode and the distinct difference in appearance of such modes from a balanced or quadribalanced type real time display provides coordination and consistency of the setting functions, with differentiation from the real time display, thus enhancing a viewer's complete comprehension of these respective time modes.

Other features and details of the invention will be understood from the ensuing specific description read in connection with the drawings.

DESCRIPTION OF THE PREFERRED EMBODIMENT

As earlier noted, in the previously cited balanced and quadribalanced digital time displays, minute digits flank alternate sides of centrally positioned hour displays, first on the right during the first half hour and thereafter on the left during the second half hour. The same is true for similar displays described in U.S. Pat. No. 6,584,041 B1, entitled Unidirectional Segmented Digital Time Displays, the disclosure of which is incorporated herein by reference. Therefore, half or more of these displays is not occupied by real time minutes during the course of each hour.

Figure 1:
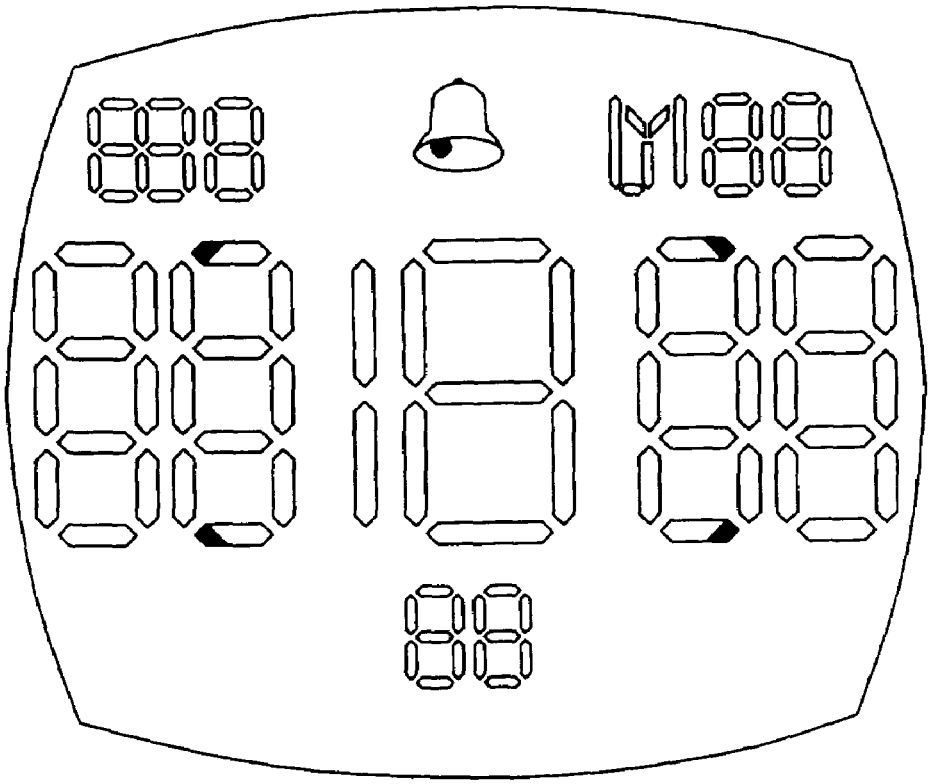
FIG. 1 is a layout drawing of digital display elements that is similar to FIG. 1 of U.S. Pat. No. 6,215,736 B1.
Figure 2:
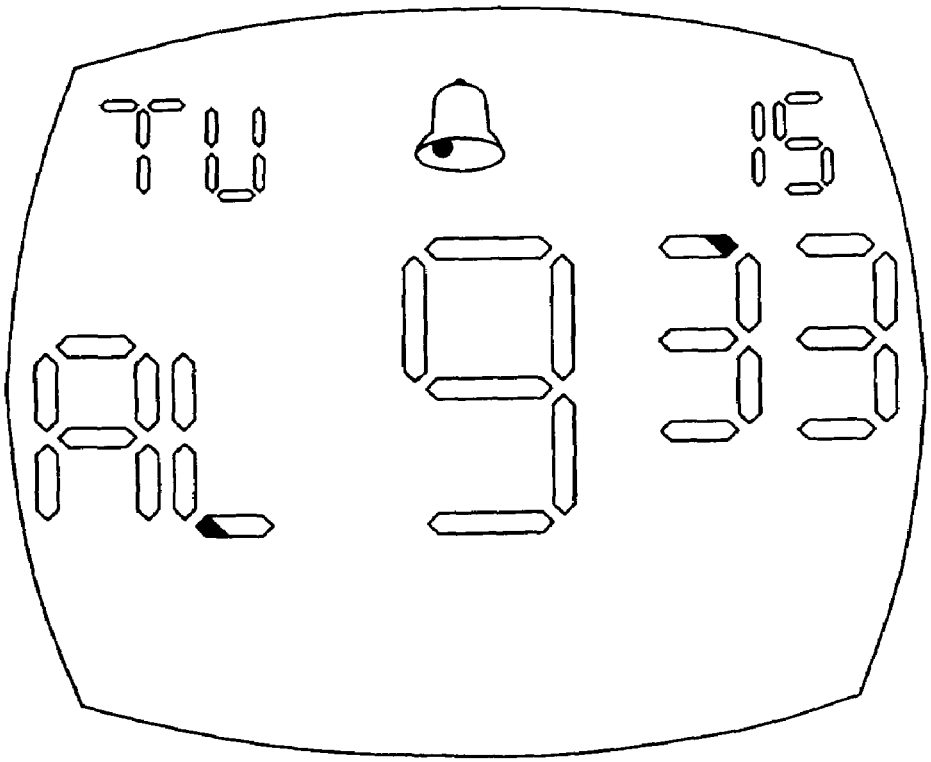
FIG. 2 is a display activated from FIG. 1 with a prompt for an alarm time setting mode.
Figure 7:
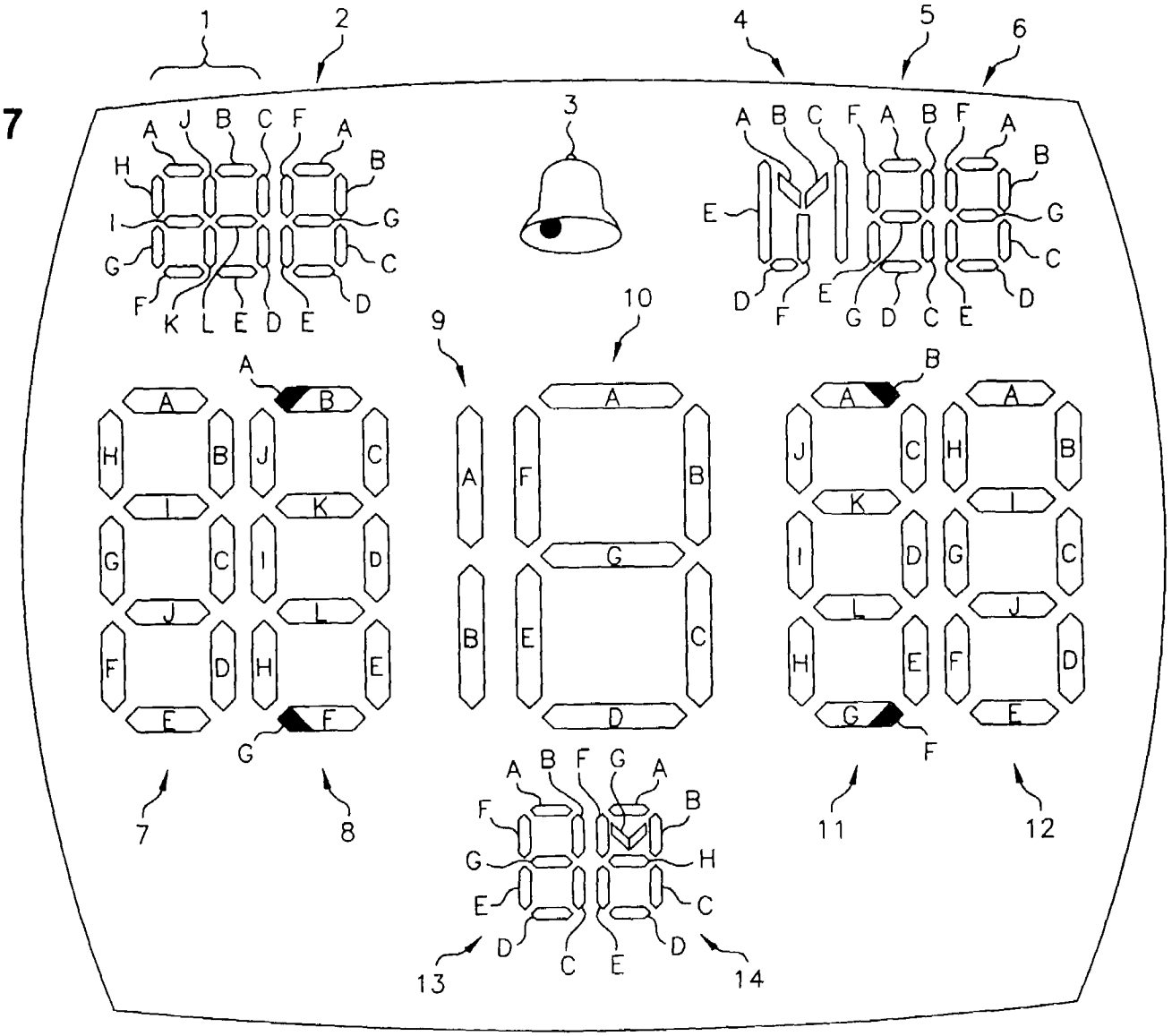
FIG. 7 is a copy of FIG. 1 with added alphanumeric labels for each display element.

In order to distinguish these appearances, whenever it is desired to set or reset real or alarm time values or calendar values presented by such displays, the display is preferably selectively activated to generate a visually different display. Referring initially to FIG. 2, a display is there illustrated which includes an alarm bell icon, centrally positioned above the hour digit 9, and the letters AL flanking the left side of the hour digit, formed by activation of the corresponding elements of FIG. 1, to prompt the viewer to the fact that the display is in a mode that permits setting or resetting an alarm time. The AL prompt is formed by activating the elements 7ICDFGJ and 8IHGF (see FIG. 7).

In real time, the previously cited prior art balanced displays would show corresponding equivalent remaining time values, with the left side of the central hour display occupied by 27 minutes before the next hour 10, and the right side of the hour empty. In the prior art quadribalanced and enhanced quadribalanced time displays, as well as the unidirectional segmented displays, there also would be no minutes on the right side of the hour, and the remaining or elapsed minutes would appear in a relatively lower position on the left side of that hour.

Thus, the display of FIG. 2 provides an immediately recognizable different appearance from any of the above-referenced real time displays. Coupled with the formation of the letters AL (signifying alarm time setting) in the leading position on the left side of the hour, which preferably is programmed to remain activated throughout the ensuing setting or resetting procedure, FIG. 2 will be unmistakably understood by the viewer that the display has been converted to a setting or resetting mode for entering the value of an alarm time. Preferably that transition is performed by use of a single crown control, as described in U.S. Pat. No. 6,286,991 B1, the disclosure of which is incorporated herein by reference.

Figure 3:
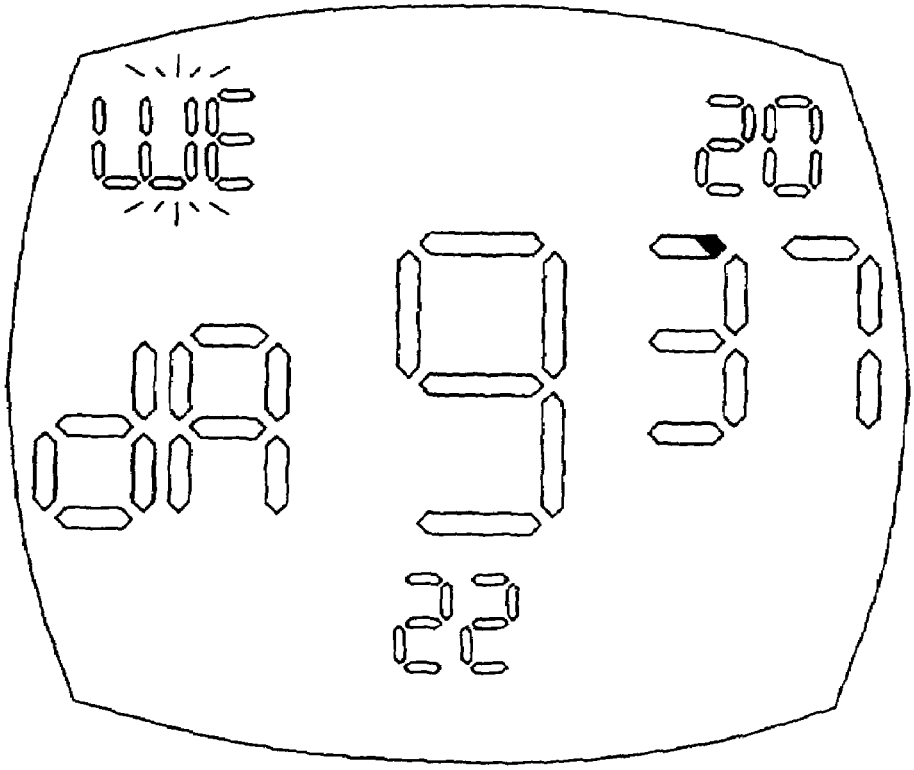
FIG. 3 is a display activated from FIG. 1 with a prompt for a day name setting mode.

That crown control is programmed to next access calendar values in the sequence of day name and thereafter month, day and year dates. FIG. 3 is an improved display for prompting the viewer to the fact that the first of such calendar functions, the name of the day, is available for setting or resetting. This is clearly indicated by the letters "dA" (signifying day name) formed in the leading position on the left of hour digit 9, together with the flashing of the WE abbreviation for Wednesday. The dA prompt is formed by activation of the elements 7CDEFJ and 8KDEHIL. Again, this display is immediately recognizable as a different appearance from the equivalent real time displays presented in the manner of the previously cited prior art patents and co-pending application.

Figure 4:
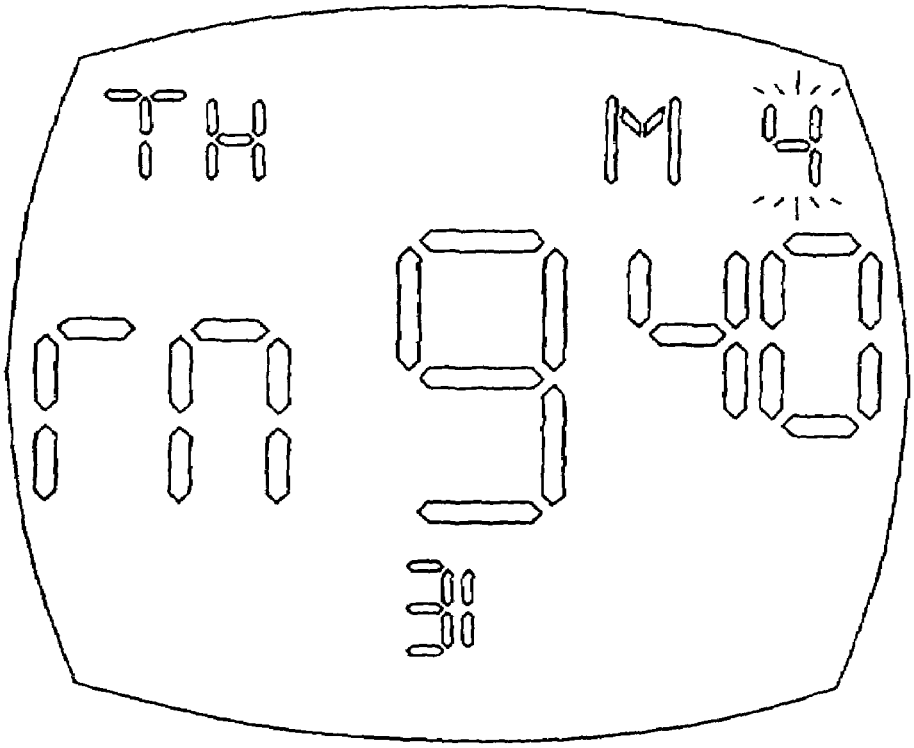
FIG. 4 is a display activated from FIG. 1 with a prompt for a month date setting mode.

FIG. 4 illustrates a display which includes a prompt M in the upper right corner adjacent the digit 4 and a larger letter M flanking the left side of hour digit. The upper prompt M is formed and used to signal the availability of a setting mode for entering the value of a month, in this case 4 for the month of April, as described in Published Application US2002/008987, published Jul. 11, 2002. In accordance with the present invention, the upper prompt is supplemented with the larger same letter M flanking the left side of hour digit 9 and formed by activation of the elements 7IGF and 8KDEHI. Thus, substantially the entire display field is occupied with the parallel prompts M which render the resulting appearance symmetrical and unmistakably a setting mode for the date of a month.

Figure 5:
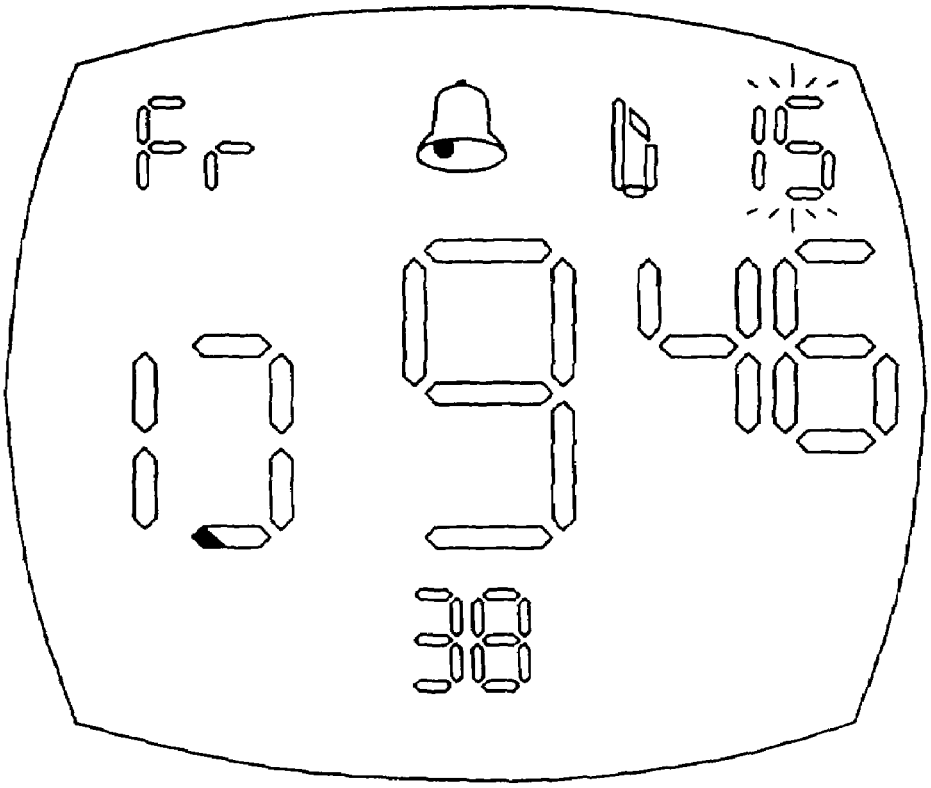
FIG. 5 is a display activated from FIG. 1 with a prompt for a day date setting mode.

FIG. 5 illustrates a similar display, this time presenting dual prompts comprising the letters D to signify that the display has accessed a setting mode for entering the date of a day. The larger letter D flanking the left side of hour 9 is formed by activation of the elements 7CD and 8KDEFG.

Figure 6:
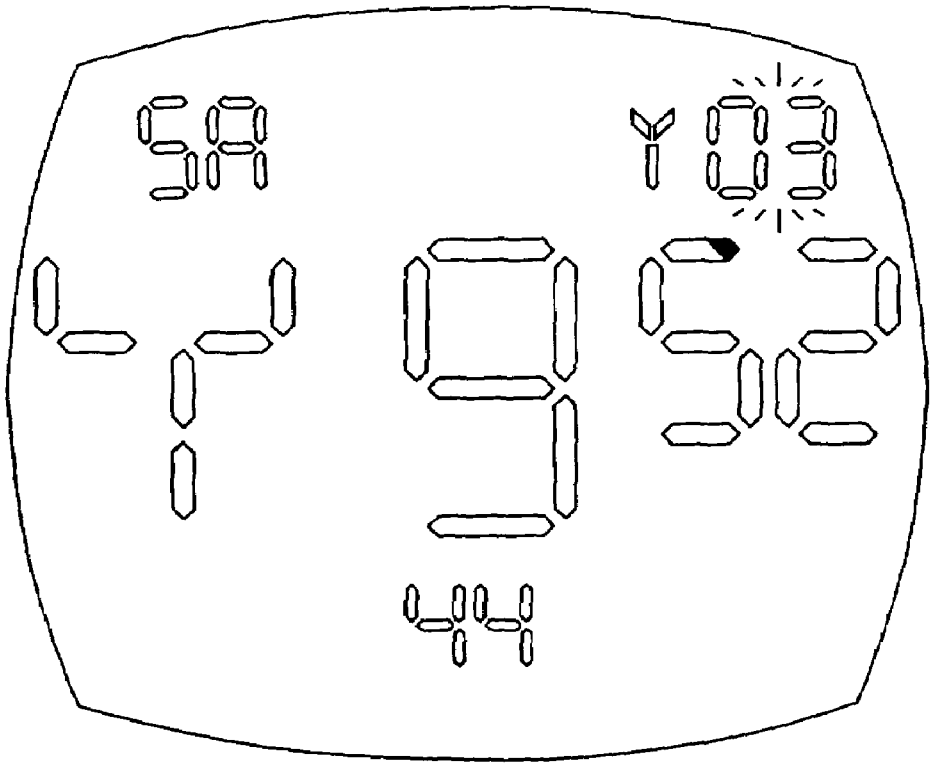
FIG. 6 is a display activated from FIG. 1 with a prompt for a year date setting mode.

FIG. 6 similarly presents symmetrical dual prompts comprising the letters Y to signal that the corresponding setting mode enables setting or resetting the date of a year defined by the last two of the year's four-digit date. The larger letter Y on the left side of hour 9 is formed by activating the elements 7HI and 8CKIH.

In FIGS. 4 and 5 the prompts M and D in the main display field are about two thirds the height of the central hour digit 9. In FIG. 6 the prompt Y is approximately the same height as the hour digit 9. The M and D prompts can be formed with approximately the same height as the Y prompt by activation of 7A, 8ABCDEHIJ and 7BCD, 8ABCDEFG, respectively. This achieves symmetry in the sizes of all three prompts for setting the category comprising the dates of months, days and year, thus creating both coordination and a visual distinction from the other prompts used in practicing the invention.

As taught in U.S. Pat. No. 6,807,130 B2, a capital letter T is formed on the left side of the centrally positioned hour digit whenever a setting mode is activated for setting or resetting the current time to real time. The letter T would be formed by activation of the elements 7I and 8KIH. That earlier application also reflects the advantage of creating a setting mode that occupies substantially the entire display field, including the large prompt T for symbolizing the fact that it is available for setting or resetting a real time value. Therefore, that disclosure can be combined with the enhanced prompts described in this application to achieve a comprehensive setting or resetting protocol that can be programmed into balanced, quadribalanced, enhanced quadribalanced or unidirectional segmented wristwatches or other timepieces for enabling the easy setting or resetting of all time and calendar functions in such products.

A preferred technique for initiating and sequencing the use of the calendar prompts dA, M, D and Y, flanking the left side of the hour display in FIGS. 2–6, is to activate each alone, followed by a predetermined time interval, on the order of one or several seconds, before the corresponding data associated with each calendar function is activated. For example, the dA prompt is activated and after a pause of preferably one second, the name of the day is activated in flashing condition. Similarly, the prompts M, D and Y on the left side of the hour display are each initiated alone, followed by the one second pause and then activation of the same steady on prompts with their adjacent flashing digital values in the upper right location of the display field.

Such sequencing aids the viewer by providing a brief prelude and introduction, in advance, of the appearance of each specific calendar function that will become available for adjustment of its value. Therefore, in that interval, the viewer will know and can prepare to think of what value needs to be addressed and set or reset, thus avoiding any perceived pressure or demand that such value adjustments must be commenced immediately were the prompts and associated data to be activated simultaneously.

The invention has now been described in terms of the preferred embodiments depicted in FIGS. 1–7. These displays provide important advantages in timepieces that operate in accordance with the teachings of the previously cited balanced, quadribalanced, enhanced quadribalanced and unidirectional segmented digital time displays. First, the prompted displays for setting or resetting real time and alarm time are both presented in the same terms as announcements of correct elapsed real times provided by telephone, radio or similar sources. Therefore, as explained above, mental conversion of these announcements to equivalent remaining times or vice versa during second half hours is entirely eliminated. The displays of the invention, instead, are totally differentiated in appearance from the cited real time displays. Therefore, setting or resetting of all time and calendar functions can be readily performed without uncertainty, confusion or substantial risk of error.

The present invention may be practiced with various forms of digital display elements, e.g., LCD, LED, fluorescent, incandescent, gaseous glow or plasma discharges, and stick-shaped or dot matrix elements that can be selectively activated, electronically or electrically, to display the time values and sequences described above.

In conclusion, the present invention has been described in terms of its general principles and specific embodiments. Many variations of such disclosure will be obvious to those skilled in the art. Accordingly, it should be understood that the ensuing claims are intended to cover all changes and modifications of the specific illustrative embodiments which fall within the literal scope of the claims and all equivalents thereof.

The invention claimed is:

1. In time display systems that provide balanced, quadribalanced, enhanced quadribalanced or unidirectional segmented digital timekeeping displays, an enhanced prompted display for indicating that the display is in a mode for setting or resetting an alarm time which comprises:

(a) digital display elements activated to display the letters AL;

(b) digital display elements activated to display an alarm hour on the right side of the letters AL; and (c) digital display elements activated to display elapsed alarm minutes on the right side of the alarm hour, said AL letters being displayed in a position which is substantially the same as where real time minutes are displayed during the second half hour of real time depicted by any of the aforesaid time display systems;

whereby a viewer is prompted by the letters AL to set or reset the display to either or both of an alarm hour and elapsed alarm minutes.

2. An enhanced prompted display according to claim 1 which includes an activated bell icon displayed above the displays of the letters AL and an alarm hour and elapsed alarm minutes.

3. An enhanced prompted display according to claim 2 wherein the overall sizes of the hour and minutes displays are graduated such that the alarm hour is the largest and the elapsed alarm minutes are smaller.

4. An enhanced prompted display according to claim 3 wherein the elapsed alarm minutes display is in a relatively upper position on the right side of the alarm hour display.

5. An enhanced prompted display according to claim 4 which includes a display of the name and the date of the current day above the displays of the letters AL and the alarm hour and elapsed alarm minutes.

6. In time display systems that provide balanced, quadribalanced, enhanced quadribalanced or unidirectional segmented digital timekeeping displays, an enhanced prompted display for indicating that the display is in a mode for setting or resetting day names which comprises:

(a) digital display elements activated to display the letters dA, (b) digital display elements activated to display a current hour on the right side of the letters dA, (c) digital display elements activated to display elapsed minutes on the right side of the current hour, and (d) digital display elements activated to display an abbreviated name of a day, said dA letters being displayed in a position which is substantially the same as where real time minutes are displayed during the second half hour of real time depicted by any of the aforesaid time display systems, whereby the viewer is prompted by the letters dA to set or reset the display to the name of the current day.

7. An enhanced prompted display according to claim 6 wherein the letters dA are initially activated alone in steady on condition, followed by a predetermined time interval after which the abbreviated name of a day is activated in flashing condition.

8. An enhanced prompted display according to claim 7 wherein the predetermined time interval is one second.

9. An enhanced prompted display according to claim 6 which includes digital display elements activated to display incrementing seconds below the current hour.

10. An enhanced prompted display according to claim 9 wherein the overall sizes of the hour, minutes and seconds displays are graduated such that the hour is the largest, minutes are smaller and seconds are the smallest.

11. An enhanced prompted display according to claim 10 wherein the elapsed minutes display is in a relatively upper position on the right side of the hour display.

12. In time display systems that provide balanced, quadribalanced, enhanced quadribalanced or unidirectional segmented digital timekeeping displays, an enhanced prompted display for indicating that the display is in a mode for setting or resetting month dates which comprises, (a) digital display elements activated to display the letter M;

(b) digital display elements activated to display a current hour on the right side of the letter M;

(c) digital display elements activated to display elapsed minutes on the right side of the current hour, said letter M being displayed in a position which is substantially the same as where real time minutes are displayed during the second half hour of real time depicted by any of the aforesaid time display systems, whereby a viewer is prompted by the letter M to set or reset the display to the date of the current month.

13. An enhanced prompted display according to claim 12 which includes a display of a second fetter M adjacent digital values of month dates, whereby a viewer is prompted by both letters M to set or reset the display to the date of the current month.

14. An enhanced prompted display according to claim 13 wherein the letter M of claim 10(a) is initially activated alone in steady on condition, followed by a predetermined time interval after which the second letter M and the digital values of month dates are activated in respective steady on and flashing conditions.

15. An enhanced prompted display according to claim 14 wherein the predetermined interval is one second.

16. An enhanced prompted display according to claim 15 wherein the second letter M and the adjacent digital values of month dates are in a position above the displays of the current hour and elapsed minutes.

17. An enhanced prompted display according to claim 16 which includes digital display elements activated to display incrementing seconds below the current hour.

18. An enhanced prompted display according to claim 17 wherein the overall sizes of the hour, minutes and seconds are graduated such that the hour is the largest, minutes are smaller and seconds are the smallest.

19. An enhanced prompted display according to claim 18 wherein the elapsed minutes display is in a relatively upper position on the right side of the hour display.

20. In time display systems that provide balanced, quadribalanced, enhanced quadribalanced or unidirectional segmented digital timekeeping displays, an enhanced prompted display for indicating that the display is in a mode for setting or resetting day dates Which comprises, (a) digital display elements activated to display the letter D, (b) digital display elements activated to display a current hour on the right side of the letter D;

(c) digital display elements activated to display elapsed minutes on the right side of the current hour, said letter D being displayed in a position which is substantially the same as where real time minutes are displayed during the second half hour of real time depicted by any of the aforesaid time display systems, whereby a viewer is prompted by the letter D to set or reset the display to the date of the current day.

21. An enhanced prompted display according to claim 20 which includes a display of a second letter D adjacent digital values of day dates, whereby a viewer is prompted by both letters D to set or reset the display to the date of the current day.

22. An enhanced prompted display according to claim 21 wherein the letter D of claim 20(*a*) is initially activated alone in steady on condition, followed by a predetermined time interval after which the second letter D and the digital values of day dates are activated in respective steady on and flashing condition.

23. An enhanced prompted display according to claim 22 wherein the predetermined interval is one second.

24. An enhanced prompted display according to claim 23 wherein the second letter D and adjacent day dates are in a position above the displays of the current hour and elapsed minutes.

25. An enhanced prompted display according to claim 24 which includes digital display elements activated to display incrementing seconds below the current hour.

26. An enhanced prompted display according to claim 25 wherein the overall sizes of the hour, minutes and seconds are graduated such that the hour is the largest, minutes are smaller and seconds are the smallest.

27. An enhanced prompted display according to claim 26 wherein the elapsed minutes display is in a relatively upper position on the right side of the hour display.

28. In time display systems that provide balanced, quadribalanced, enhanced quadribalanced or unidirectional segmented digital timekeeping displays, an enhanced prompted display for indicating that the display is in a mode for setting or resetting year dates which comprises, (a) digital display elements activated to display the letter Y;

(b) digital display elements activated to display a current hour on the right side of the letter Y; and (c) digital display elements activated to display elapsed minutes on the right side of the current hour, said letter Y being displayed in a position which is substantially the same as where real time minutes are displayed during the second half hour of real time depicted by any of the aforesaid time display systems, whereby a viewer is prompted by the letter Y to set or reset the display to the date of the current year.

29. An enhanced prompted display according to claim 28 which includes a display of a second letter Y adjacent digital values of year dates, whereby a viewer is prompted by both letters Y to set or reset the display to the date of the current year.

30. An enhanced prompted display according to claim 29 wherein the letter Y of claim 28(*a*) is initially activated alone in steady on condition, followed by a predetermined time interval after which the second letter Y and the digital values of year dates are activated in respective steady on and flashing condition.

31. An enhanced prompted display according to claim 30 wherein the predetermined interval is one second.

32. An enhanced prompted display according to claim 31 wherein the second letter Y and the adjacent digital values of year dates are in a position above the displays of the current hour and elapsed minutes.

33. An enhanced prompted display according to claim 32 which includes digital display elements activated to display incrementing seconds below the current hour.

34. An enhanced prompted display according to claim 33 wherein the overall sizes of the hour, minutes and seconds are graduated such that the hour is the largest, minutes are smaller and seconds are the smallest.

35. An enhanced prompted display according to claim 34 wherein the display of elapsed minutes is in a relatively upper position on the right side of the hour display.

* * * * *